US008984768B2

(12) United States Patent
Volkers

(10) Patent No.: US 8,984,768 B2
(45) Date of Patent: Mar. 24, 2015

(54) METHOD AND APPARATUS FOR DRYING A PIECE OF TEXTILE

(75) Inventor: Henrik Volkers, Braunschweig (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1494 days.

(21) Appl. No.: 11/989,454

(22) PCT Filed: Jun. 26, 2006

(86) PCT No.: PCT/EP2006/063529
§ 371 (c)(1),
(2), (4) Date: Jun. 9, 2009

(87) PCT Pub. No.: WO2007/012529
PCT Pub. Date: Feb. 1, 2007

(65) Prior Publication Data

US 2009/0300938 A1 Dec. 10, 2009

(30) Foreign Application Priority Data

Jul. 29, 2005 (DE) ..... 10 2005 035 653

(51) Int. Cl.
*F26B 3/02* (2006.01)
*D06F 58/28* (2006.01)

(52) U.S. Cl.
CPC . *D06F 58/28* (2013.01); *F26B 3/02* (2013.01); *D06F 2058/2893* (2013.01)
USPC ..... 34/468; 34/471; 34/476; 34/493; 34/495; 34/499

(58) Field of Classification Search
USPC ..... 34/467, 468, 493, 495, 498, 499, 549, 34/553, 72, 73, 132, 595, 471, 476, 477
See application file for complete search history.

(56) References Cited

U.S. PATENT DOCUMENTS

| | | | | |
|---|---|---|---|---|
| 3,218,730 | A * | 11/1965 | Menk et al. | 34/527 |
| 3,253,346 | A * | 5/1966 | Gosnell | 34/546 |
| 3,254,423 | A * | 6/1966 | Ruelle | 34/543 |
| 3,621,202 | A | 11/1971 | Gemert | |
| 4,713,894 | A | 12/1987 | Roth et al. | |
| 4,763,425 | A * | 8/1988 | Grennan | 34/552 |

FOREIGN PATENT DOCUMENTS

| | | |
|---|---|---|
| EP | 1 321 562 | 6/2003 |
| EP | 1 321 563 | 6/2003 |

OTHER PUBLICATIONS

International Search Report PCT/EP2006/063529.

* cited by examiner

*Primary Examiner* — Jiping Lu
(74) *Attorney, Agent, or Firm* — Nixon & Vanderhye P.C.

(57) ABSTRACT

A method and an apparatus for drying a piece of textile which is impinged upon by an air flow having a varied partial steam pressure to evacuate moisture. The method and apparatus are particularly suitable for drying a piece of textile with a layered structure having a semi-permeable membrane.

19 Claims, 2 Drawing Sheets

METHOD AND APPARATUS FOR DRYING A PIECE OF TEXTILE

This application is a U.S. National Phase of International Application No. PCT/EP2006/063529, filed Jun. 26, 2006, which designates the U.S. and claims priority to German Application No. 102005035653.2, filed Jul. 29, 2005, the entire contents of each are hereby incorporated by reference.

The invention relates to a method and an apparatus for drying a piece of textile, wherein drying occurs due to the fact that the piece of textile is impinged upon by an air flow to evacuate moisture, a partial water vapor pressure in the air flow being varied.

BACKGROUND OF THE INVENTION

A method and an apparatus of this kind are disclosed in document EP 1 321 562 A2. In said document a method and an apparatus are attuned to a problem in which a piece of cotton textile tends to shrink if dried at a relatively high temperature in a conventional washer-dryer. Accordingly, document EP 1 321 562 A2 specifies that the said drying procedure takes place at a temperature that is reduced in comparison with an initial temperature if the moisture in the drying piece of textile, as determined by a suitable sensor, drops below a specified point. The determining thermodynamic laws dictate that a temperature reduction in an air flow that contains water vapor implies a reduction in the partial water vapor pressure in the said air flow, though document EP 1 321 562 A2 contains no proposal or theory in this regard.

Instructions on the construction and operation of an apparatus for drying a piece of textile, as embodied in a conventional washer-dryer, emerge from document EP 1 321 562 A2 and from document EP 1 321 563 A2. The disclosures in the said documents are accordingly taken fully into account in the present disclosure.

An automatic washer-dryer is disclosed in U.S. Pat. No. 4,763,425. In the case of said washer-dryer, the temperature at which the washing is dried is controlled by reference to the type of textile of which the washed articles are made and the desired level of dryness required in said articles. The temperature is controlled by switching an electrical heating element on and off, holding the temperature constant to within a small margin, in particular plus or minus 5 degrees Fahrenheit (3 Kelvin), throughout the drying process.

An automatic washer-dryer is also known from U.S. Pat. No. 4,713,894. In such a washer-dryer, a drying piece of textile is impinged upon by an air flow to evacuate moisture, an oscillating partial pressure being generated in the air flow impinging on the piece of textile by switching a heating device on and off. For this purpose the washer-dryer disclosed in U.S. Pat. No. 4,713,894 varies the temperature of the air flow between 96.11° C. and 101.67° C. (a difference of 5.56 Kelvin).

A textile material that is built up in layers, one of which is known as a functional membrane, and is a semipermeable membrane allowing water vapor to pass through but keeping out water in liquid form, is widely used in sports outfits, rainwear and winter clothing, since material of said kind has particularly favorable wear characteristics. Such functional membranes are marketed under the brand names GoreTEX and Sympatex. Although in principle such material requires no specific precautions to be taken to protect the functional membrane during washing or cleaning, nevertheless a problem arises when drying a damp piece of this type of textile in a conventional washer-dryer: Since liquid water cannot penetrate a functional membrane of said kind, it is not possible to dry a piece of textile of this type uniformly in a conventional drying process. Since moisture shielded by the functional membrane from the air flow used for drying cannot access the air flow while in the form of moisture, it must be evaporated in order to make its way out through the functional membrane and reach the air flow. In the case of a piece of textile that includes a functional membrane, the conventional drying process performs in this way to only a limited extent and takes significantly longer.

SUMMARY OF THE INVENTION

The object of the invention described below is therefore to specify a generic method and a generic apparatus, in order to deal with the problem described above and be able to provide rapid and gentle drying of a piece of textile that includes a semipermeable membrane.

To achieve this object a method is specified for drying a piece of textile that has a semipermeable membrane, wherein said piece of textile is impinged upon by an air flow to evacuate moisture, a partial water vapor pressure in the air flow being varied, and during said method the air flow impinging upon the piece of textile exhibits an oscillating partial water vapor pressure, and a partial pressure gradient is generated over the membrane, being sufficient to drive water vapor out through said membrane.

To achieve this object an apparatus for drying a piece of textile that has a semipermeable membrane is also specified, and comprises a) a processing space to accommodate the piece of textile;

b) a means of generating an air flow to evacuate moisture from the piece of textile, the air flow having a variable partial water vapor pressure;

c) a control device which is set up to generate an oscillating partial water vapor pressure in the air flow and to generate a partial pressure gradient over the membrane, being sufficient to drive water vapor out through said membrane.

The invention is based on the finding that in addition to creating an adapted temperature and adapted flow conditions for drying a piece of textile that has a semipermeable membrane, it is also necessary to ensure that the greatest possible gradient in partial water vapor pressure is generated via the semipermeable membrane in order that the moisture in the piece of textile shielded by the semipermeable membrane evaporates and is driven out through the membrane. The invention is further based on the finding that such a partial pressure gradient cannot be achieved when there is dynamic equilibrium, as always occurs in the context of a conventional drying process. The invention therefore provides for the partial water vapor pressure in the air flow around the piece of textile to be deliberately varied. This is done by varying the partial pressure during the drying process in an oscillating manner, that is, relatively rapidly compared to the overall process time. At a high partial pressure and a correspondingly high temperature the moisture in the piece of textile is heated up so that it evaporates and is then made ready to pass through the semipermeable membrane. At a low partial pressure in the air flow and a correspondingly low temperature if need be, the evaporated moisture is driven out through the membrane. The invention thus enables relatively fast drying of a piece of textile that has a semipermeable membrane, and at a moderate temperature loading.

The preferred embodiments described below relate equally to the inventive method and the inventive apparatus.

The oscillating partial pressure is preferably brought about by an oscillating temperature in the air flow; in the corresponding apparatus, in particular a device for heating the air flow is provided for said purpose, being capable of heating the air flow in an appropriately oscillating fashion, in particular switching it cyclically on and off.

A particularly preferred embodiment requires the heating to be switched alternately on and off, in particular by an appropriately set up control device, each off period lasting between 100 and 200 s, in particular between 120 and 180 s. In this case it is provided in particular that in order to dry a single piece of textile having a semipermeable membrane, each off period lasts around 180 s. It is very important to bring about a significant fluctuation in the partial water pressure in the air flow by alternately switching the heating on and off, in order to achieve the required disruption to the dynamic equilibrium in the semipermeable membrane.

A preferred embodiment with regard to adjusting the variable air flow temperature requires the temperature to oscillate with an amplitude of at least 10 Kelvin and in particular about 20 Kelvin. The required disruption to the dynamic equilibrium in a semipermeable membrane can then be achieved in a suitable and practical manner. It is possible and advantageous to control the method via an appropriately set up control device, fitted if necessary with appropriate and known sensor technology. It should be noted that not only heating devices operated in an oscillating manner but also oscillating temperatures are already known from the prior art; however, such oscillations are subject to technical constraints, in particular due to strict conditions regarding the permitted outlay for a marketable product. These oscillations are actually disadvantageous from the operating point of view, since they delay the entry of energy into the drying process, which they thus lengthen, and in the context of the prior art are always kept as small as possible. This paradigm is inventively resolved in order to create a practical and rapid drying process for textiles that have functional membranes.

It is also preferable for the piece of textile to be moved about in the air flow, for example by a rotating drum into which the piece of textile is introduced. By this means the piece of textile is dried in a way that is especially uniform as well as rapid and gentle.

It is further preferable for the air flow to be circulated in a loop or circuit, for which purpose the apparatus is embodied as a condensation type washer-dryer. The said circuit comprises a blower to drive the air flow, a condenser to condense out the moisture and a heating device to heat the air flow after the said air flow has had its moisture condensed out in the condenser. On leaving the heating device the air flow again enters the processing space, from where it goes to the condenser; the blower can be located just about anywhere in the circuit.

The oscillating partial water vapor pressure can be set up in the air flow so that moisture is condensed out of the air flow after said air flow has impinged upon the piece of textile in an oscillating fashion. In particular this is brought about in the apparatus by providing the circuit with an appropriately equipped condenser that can be suitably regulated by the control device. This control can be exercised by regulating the dissipation of heat from the condenser. In a condenser which uses ambient air as the heat exchange medium, the condensation level can be regulated by controlling the supply of ambient air for heat exchange purposes.

The apparatus is preferably capable of simultaneously drying a plurality of pieces of textile.

Preferably the method is to be applied and the apparatus is to be specified for drying a piece of textile that is provided with a layered structure encompassing a semipermeable membrane. In this connection the apparatus is embodied with a particular preference for a control device that provides users with a choice between a plurality of methods for drying a piece of textile, one of said methods being embodied in the manner just described and being offered for the purpose of drying a piece of textile that is provided with a layered structure encompassing a semipermeable membrane.

BRIEF DESCRIPTION OF THE DRAWINGS

Exemplary embodiments of the invention will be explained below with the aid of the attached drawings.

In detail the drawings show the following.

DETAILED DESCRIPTION OF THE EXEMPLARY EMBODIMENTS OF THE PRESENT INVENTION

Figure 1:
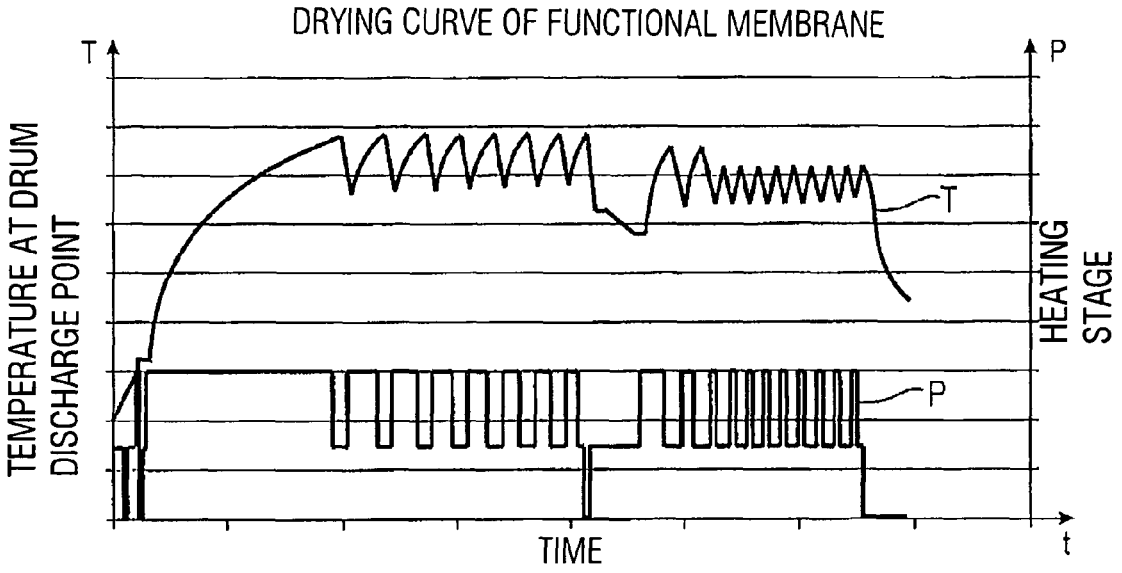
FIGS. 1 and 2: Curves of the temperature and heat output in a method for drying a piece of textile according to teaching that is disclosed here or already known.
Figure 2:
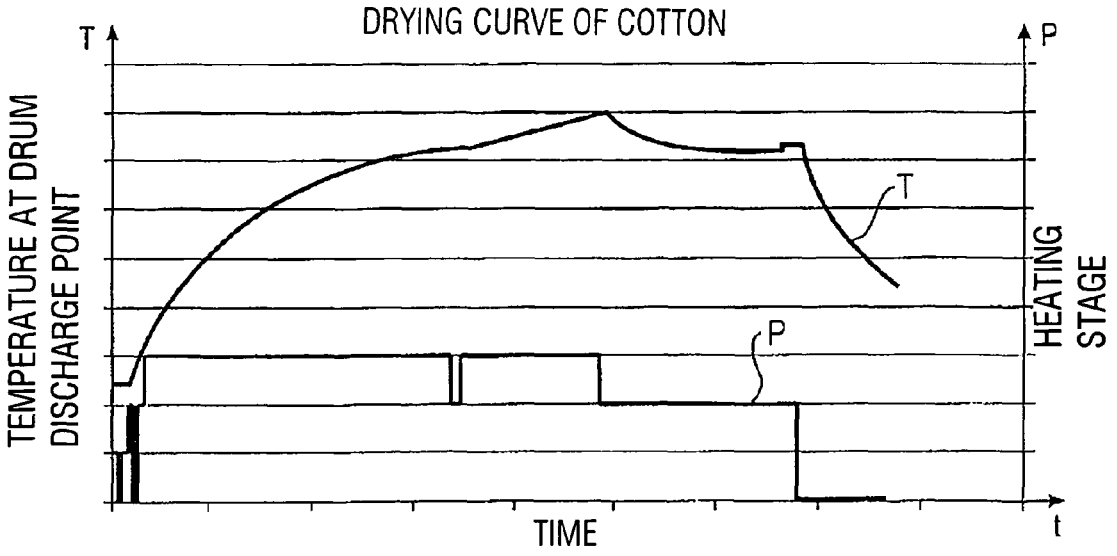

In FIG. 1 and FIG. 2 let it be assumed that the drying of a piece of textile begins at point in time zero. As can be seen from FIG. 2, an air flow used for drying is heated strongly and to all intents and purposes continuously; this is illustrated in the lower curve labeled with the letter P, where the temperature rapidly and continuously rises to a specified value—see the curve labeled with the letter T. In the subsequent curve for the process the temperature T reaches a defined threshold, whereupon the heat output is reduced in order to keep the air flow at a constant temperature throughout. At the end of the drying, as defined by a suitable sensor which determines the moisture remaining in the dried pieces of textile, the heat is turned off and the temperature T falls to a value corresponding to the ambient temperature. That is the end of the process.

FIG. 1 shows the curve of the temperature T and heat output P in a method according to the present new teaching. After continuous heating to reach a measured temperature level for drying, the temperature T is not held constant throughout, but instead is oscillated in relatively rapid stages about an average value; preferred time and temperature values can be inferred from the preferred embodiments described above. For this purpose the heating is operated in oscillating fashion. This oscillation breaks the dynamic equilibrium which would occur in the process shown in FIG. 2 and encourages the evacuation of moisture through a semipermeable membrane.

Pieces of textile corresponding to the above can therefore be dried significantly faster by a process according to FIG. 1 than by a process according to FIG. 2.

Figure 3:
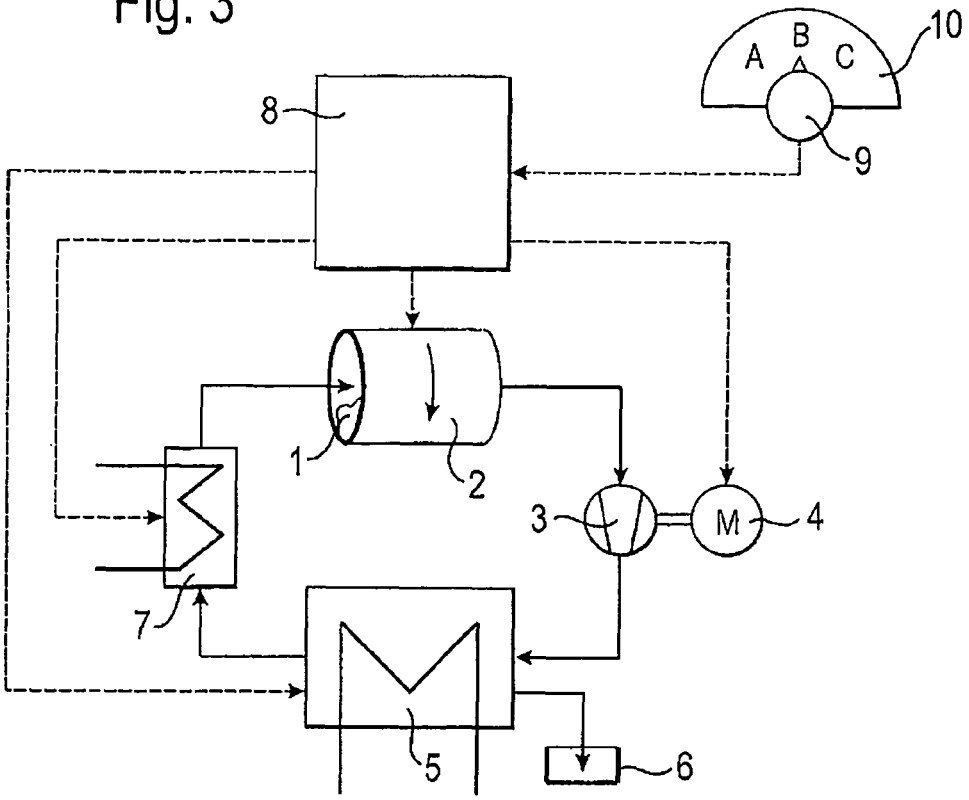
FIG. 3: A sketch of an apparatus for performing the method disclosed here.

FIG. 3 shows a sketch of an apparatus for drying a piece of textile 1. This piece of textile is inside a rotating drum 2 within a processing space pervaded by an air flow which is represented by arrows drawn with solid lines. This air flow is at a suitably high temperature to evacuate moisture from the piece of textile 1. The air flow is driven by a blower 3, itself driven by a motor 4. The air flow passes from the blower 3 to a condenser 5 in which the air flow is cooled and part of the moisture it carries is condensed out. The condensed moisture is fed to a trap 6 and disposed of according to the usages of the apparatus. The air flow, which is now cooled and free of moisture, passes from the condenser 5 to a heating device 7, where it is once more heated up to the desired temperature for dealing with the piece of textile 1. The air flow passes from the heating device 7 back to the drum 2 and the piece of textile 1. An appropriately programmed control device 8 is provided to regulate the apparatus in the context of the process just described. The control device 8 controls the drum 2, the blower 3, the condenser 5 and the heating device 7. The control device is designed and set up in order to generate an oscillating partial water vapor pressure in the air flow impinging on the piece of textile. For this purpose the control device has access to the heating device 7 and/or the condenser 5.

The apparatus provides users with a choice between a plurality of methods for drying a piece of textile. Said choice is made by means of a rotary knob 9 which has a suitable scale 10.

Figure 4:
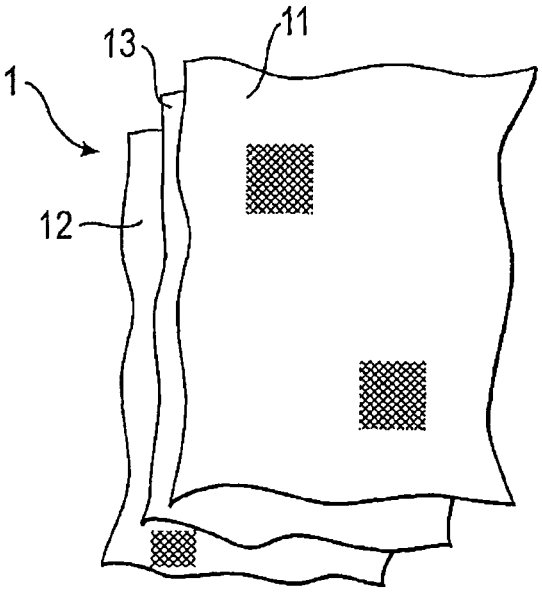
FIG. 4: A sketch of a piece of textile having a layered structure and a semipermeable membrane.

FIG. 4 shows a sketch of a piece of textile 1 having a layered structure. In this structure a semipermeable membrane 13 is inserted between an upper textile layer II and a lower textile layer 12. This semipermeable membrane 13 can be provided as an independent component or as a layer on a suitable supporting material.

The invention claimed is:

1. A method for drying a piece of textile, wherein the piece of textile has a layered structure encompassing a semi-permeable membrane that allows water vapor to pass through but keeps out water in liquid form, the method comprising:

generating an air flow having an oscillating partial water vapor pressure; and driving the water vapor out of the piece of textile through the semi-permeable membrane by impinging the piece of textile with the air flow, wherein the driving the water vapor out includes:

evacuating moisture and generating a partial pressure gradient over the semi-permeable membrane, wherein the evacuating and the generating deliberately varies and disrupts a dynamic equilibrium in the semi-permeable membrane.

2. The method of claim 1, wherein the generating of the air flow includes oscillating a temperature of the air flow.

3. The method of claim 2, wherein oscillating the temperature of the air flow includes heating the air flow in an oscillating fashion.

4. The method of claim 3, wherein the heating the air flow includes switching the heating alternately on and off, each off period lasting between 100 and 200 s.

5. The method of claim 3, wherein the heating the air flow includes switching the heating alternately on and off, and each off period lasts around 180 s.

6. The method of claim 5, further comprising condensing moisture out of the air flow in an oscillating fashion after impinging upon the piece of textile.

7. The method of claim 3, wherein heating the air flow includes switching the heating alternately on and off, each off period lasting between 120 and 180 s.

8. The method of claim 2, wherein the oscillating the temperature includes oscillating with an amplitude of at least 10 Kelvin.

9. The method of claim 2, wherein the oscillating the temperature includes oscillating with an amplitude of about 20 Kelvin.

10. The method of claim 1, further comprising moving the piece of textile in the air flow.

11. The method of claim 1, further comprising circulating the air flow within a circuit.

12. A method for drying a piece of textile, which includes a layered structure encompassing a semi-permeable membrane that allows water vapor to pass through the textile and prevents water in liquid form from passing through the textile, in a drying apparatus, the apparatus comprising a container for accommodating the piece of textile, an air flow generator, and a controller controlling the air flow generator, the method comprising:

deliberately varying and disrupting a dynamic equilibrium in the semi-permeable membrane in the container and driving the water vapor out of the piece of textile through the semi-permeable membrane, wherein the deliberately varying and disrupting the dynamic equilibrium in the semi-permeable membrane and driving the water vapor out of the piece of textile includes:

generating an air flow in the container having the piece of textile using the air flow generator, the generated air flow having an oscillating partial water vapor pressure; and evacuating moisture and generating a partial pressure gradient over the semi-permeable membrane by impinging the piece of textile in the container with the air flow.

13. The method of claim 12, wherein the generating of the air flow includes oscillating a temperature of the air flow, wherein the oscillating the temperature of the air flow includes heating the air flow in an oscillating fashion.

14. The method of claim 13, wherein the heating the air flow includes switching the heating alternately on and off, wherein each off period is equal to or greater than 100 sand equal to or less than 200 s.

15. The method of claim 14, wherein the heating the air flow includes switching the heating alternately on and off, wherein each off period is 180 s.

16. The method of claim 13, wherein the oscillating the temperature includes oscillating the temperature by an amplitude of at least 10 Kelvin.

17. The method of claim 13, wherein the heating the air flow includes switching the heating alternately on and off, wherein each off period is equal to or greater than 100 sand equal to or less than 200 s, and wherein the oscillating the temperature includes oscillating the temperature by an amplitude of at least 10 Kelvin.

18. The method of claim 17, wherein the heating the air flow includes switching the heating alternately on and off, wherein each off period is 180 s.

19. The method of claim 17, wherein the oscillating the temperature includes oscillating the temperature by an amplitude of about 20 Kelvin.

* * * * *